United States Patent [19]

Gross

[11] 4,259,888

[45] Apr. 7, 1981

[54] TONE GENERATION SYSTEM EMPLOYING TRIANGULAR WAVES

[75] Inventor: Glenn M. Gross, Chicago, Ill.

[73] Assignee: Norlin Industries, Inc., Deerfield, Ill.

[21] Appl. No.: 100,973

[22] Filed: Dec. 6, 1979

[51] Int. Cl.[3] ..... G10H 1/04; G10H 1/08

[52] U.S. Cl. ..... 84/1.22; 84/1.24; 84/DIG. 4; 84/DIG. 10

[58] Field of Search ..... 84/1.01, 1.03, 1.13, 84/1.24, 1.26, DIG. 2, DIG. 4, DIG. 10, 1.22; 328/14

[56] References Cited

U.S. PATENT DOCUMENTS

| | | | |
|---|---|---|---|
| 3,763,364 | 10/1973 | Deutsch et al. | 84/1.03 X |
| 3,809,786 | 5/1974 | Deutsch | 84/1.01 |
| 3,828,109 | 8/1974 | Morez | 84/1.01 |
| 3,994,195 | 11/1976 | Chibana et al. | 84/1.24 |
| 4,014,238 | 3/1977 | Southard | 84/1.13 |
| 4,103,582 | 8/1978 | Chibana | 84/1.24 |
| 4,116,103 | 9/1978 | Deutsch | 84/1.24 |
| 4,119,005 | 10/1978 | Kondo et al. | 84/1.01 |
| 4,133,241 | 1/1979 | Niimi et al. | 84/1.01 |
| 4,159,527 | 6/1979 | Yahata et al. | 328/14 X |
| 4,186,637 | 2/1980 | Swain et al. | 84/1.01 |

*Primary Examiner*—Stanley J. Witkowski

*Attorney, Agent, or Firm*—Ronald J. Kransdorf; Jack Kail

[57] ABSTRACT

A digital technique for triangular musical waveform generation is disclosed. A musical scale value corresponding to a selected note is repetitively added to produce an ascending series of non-consecutive numbers which is stored in a latch. A carry output from the limited modulus latch is used to switch a flip-flop which then enables an inverter to reverse the slope of the number series. Alternating reversals produce a rising and falling numerical staircase of controllable slope. This can be directly converted into a smooth triangular waveform, or alternatively it can be used as a series of memory addresses for table look-up purposes. The triangular waveform may be symmetrical, or it may have a controlled degree of asymmetry. Duplicate triangular waveforms with a small frequency mismatch may be used to produce a chorus effect. Or plural triangular waveforms with octavely related frequencies may be used as footages related to a single note, again with a slight frequency mismatch for chorus purposes. The frequency mismatch is effected by introducing extra pulses into the ascending number series by means of a synchronized carry input to the latch. When used in the table look-up mode, the invention permits great savings of waveshape memory capacity by the use of half-cycle and quarter-cycle symmetry. The latter feature is achieved by the use of a format translation from binary offset to sign-magnitude notation for table look-up purposes, after which the resulting waveshape is converted back into the original binary offset notation. The table look-up approach is also used in conjunction with plural triangular waveforms, by virtue of time-division multiplexing.

17 Claims, 32 Drawing Figures

FIG. 1
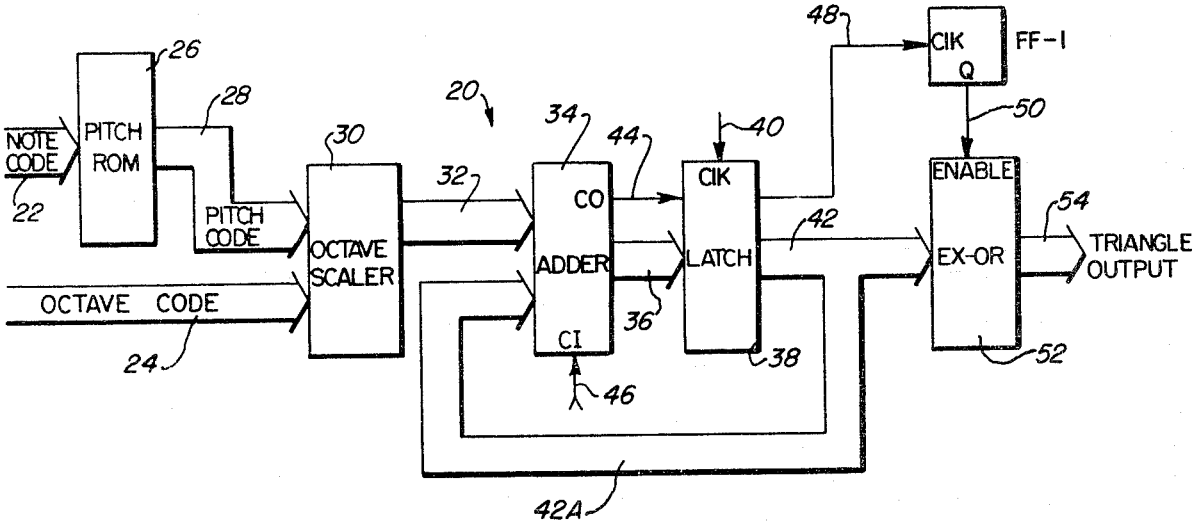
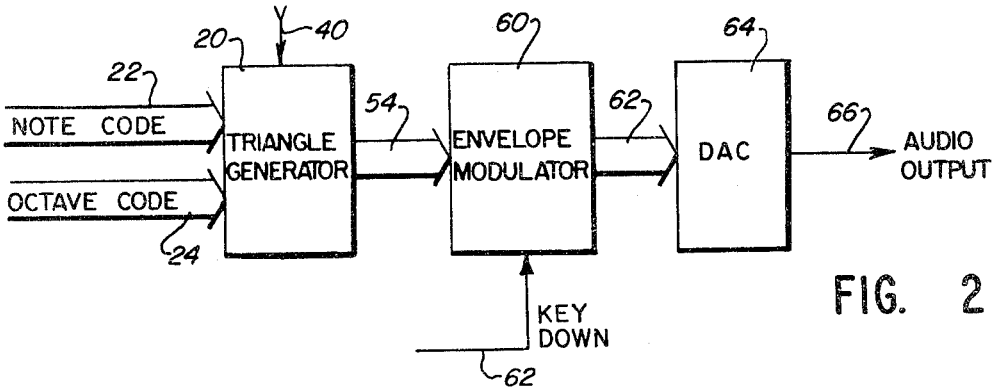
FIG. 2
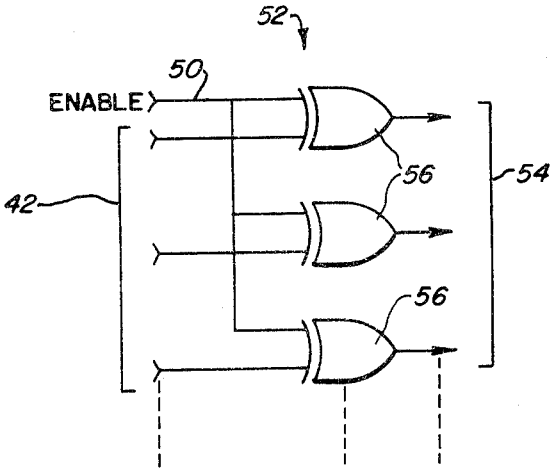
FIG. 3

OUTPUT WAVESHAPE

FF-1 INPUT

FF-1 OUTPUT

2:1 ASYMMETRY OUTPUT WAVESHAPE

FF-1 INPUT

FF-1 OUTPUT

8:1 ASYMMETRY OUTPUT WAVESHAPE

FF-1 INPUT

FF-1 OUTPUT

FIG. 9
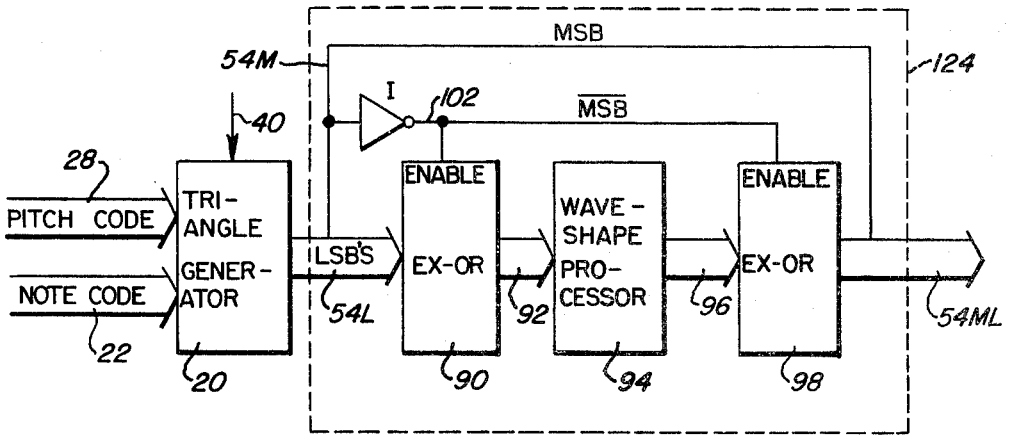
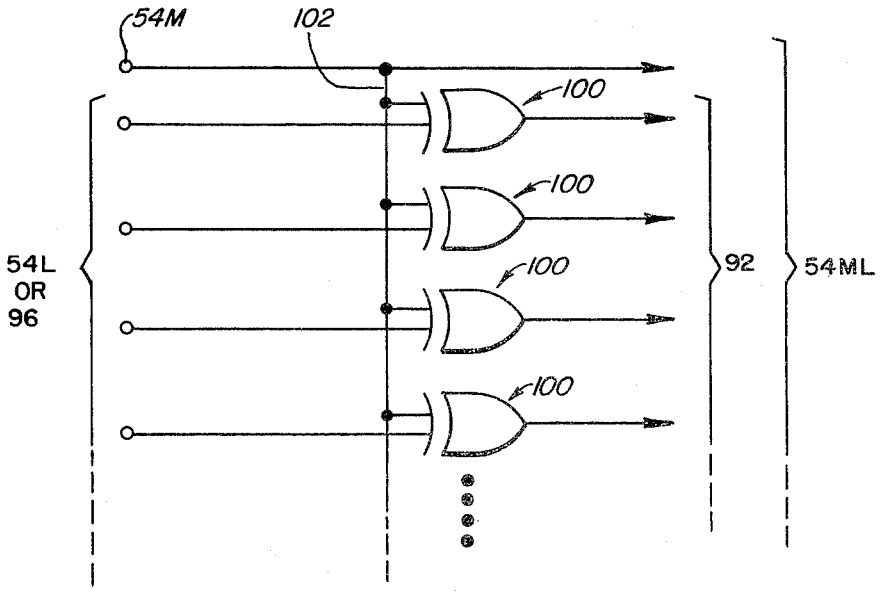
FIG. 10

110
112
114
GENERATOR OUTPUT
+ SIGN
EX - OR 90 OUTPUT
TRANSFER FUNCTION OF CONVERTER 94
CONVERTER 94 OUTPUT
EX - OR 98 OUTPUT

TONE GENERATION SYSTEM EMPLOYING TRIANGULAR WAVES

This invention relates generally to electronic musical instruments which digitally generate audio waveforms. It particularly concerns the generation of triangular waveforms, and various applications thereof.

BACKGROUND OF THE INVENTION

The electronic musical instrument art has recently turned to digital generation of audio waveforms, whereas oscillators and clocks had been used as waveform sources in the past. An early digital waveform generation technique involves storage of digital instructions in a read-only memory (ROM), each instruction numerically representing the amplitude of the desired waveform at one of several sample points. The amplitude instructions are read out of the memory in sequence, and converted into a series of voltage amplitudes by a digital-to-analog converter, thus producing an analog output waveform of the desired shape. In order to read the amplitude instructions out of the ROM in sequence, it is necessary to generate an appropriate series of memory addresses. Some simple prior art systems use an address counter driven by a clock for addressing the ROM. See, for example, U.S. Pat. No. 3,763,364 of Ralph Deutsch et al.

A somewhat more sophisticated musical waveform generation system is seen in Deutch's U.S. Pat. No. 3,809,786. There the addressing of a sine function table memory is done under the control of a different kind of address generator, one which produces a sequence of non-consecutive memory addresses which increase in numerical value at a rate proportional to the musical scale value of the note to be sounded. It does this by repetitively adding a number which is proportional to that musical scale value.

A further level of sophistication in the prior art is exemplified by the musical waveform generation system in U.S. Pat. No. 4,119,005 of Michio Kondo et al. There again an ascending series of numbers is generated by repetitively adding the musical scale value of the note to be sounded. But instead of treating this ascending series of numbers as a set of memory addresses for table look-up purposes, Kondo et al treat it as a series of waveform amplitude instructions which can be utilized in the digital-to-analog converter to produce the waveform directly. The table look-up step is eliminated.

A variety of waveforms can be produced by this method. The ascending series of amplitude instructions inherently represents a rising stair-step, which becomes smoothed by the D/A converter to form a rising ramp analog waveform. By periodically terminating and restarting such a ramp, Kondo et al can also produce a repetitive sawtooth waveform. Or by periodically reversing the sign of the slope of the ramp, they can produce a triangular waveform, the kind with which the present invention is concerned. The most significant bit of the rising number series is used by Kondo et al as a trigger to produce the slope reversal.

The triangle waveform of Kondo et al is symmetrical; i.e. the leading and trailing edges thereof are mirror images of each other. Under certain circumstances, it is musically desirable for the triangular waveform to be asymmetrical, and particularly for the degree of asymmetry to be controlled. U.S. Pat. No. 4,103,582 of Masanobu Chibana discloses a musical waveform generation system of the same general type as Deutsch's, with the addition of a "frequency shifting device" which imparts an additive correction to the calculated ascending series of amplitudes, thus altering its rate of numerical ascent. But Chibana does not show how this concept can be used to achieve triangular asymmetry.

Nor does Chibana appreciate that an additive correction might also be used to introduce a small differential between two rising numerical sequences of nominally equal, or octavely related, rise rate; resulting in a small frequency disparity which produces a chorus effect.

The table look-up procedure used by Deutsch, and by Chibana as well, may be regarded as a technique for converting one waveform to another. The procedure starts with a rising staircase number sequence (which may be regarded as a ramp voltage expressed in digital form), and uses that sequence as a series of addresses for looking up some other waveform (a sinusoid) in a memory table. By reversing the slope periodically, so that the staircase sequence rises and falls alternately, the waveform memory can be scanned bi-directionally so as to reduce the memory capacity requirement by half, provided the desired output waveform is characterized by half-cycle symmetry. It is even possible to produce a four-fold reduction in memory capacity requirements, if quarter-cycle waveform symmetry can be utilized.

Of course, bi-directional memory addressing is not in itself new, as shown by Deutsch's U.S. Pat. No. 3,763,364. But in that type of system the memory addresses are merely numerically consecutive counter states, whether increasing (counting up) or decreasing (counting down). The mere use of consecutive counter states for memory addressing affords no opportunity to chose the rate of rise or fall of the resulting series of memory addresses.

The Deutsch U.S. Pat. No. 3,809,786 demonstrates the use of time-division multiplexing techniques to permit a numerical staircase waveform generator to be shared between two or more simultaneously played organ footages.

BRIEF SUMMARY OF THE INVENTION

The present invention employs the numerical staircase technique, with periodic slope reversal to produce an alternately rising and falling triangular staircase of non-consecutive numerical values, at a controllable rate of rise and fall, just as in the prior art. But new techniques are disclosed herein for reversing the slope, and for introducing a controlled degree of asymmetry into the triangular configuration, so as to enhance the available range of musical sounds.

Another new feature is the introduction of a slight frequency mismatch between two triangular waveform generators running concurrently at nominally equal frequencies, so as to achieve a chorus effect. The mismatch is accomplished by means of an additive correction introduced in a novel way into the process of repetitive addition of a musical scale value. Such a correction can also be used to introduce a chorus discrepancy into the octavely related frequencies of separate footage generators.

Instead of using the alternately rising and falling number sequence as a direct input into a digital/analog converter, waveshape conversion can be accomplished by means of the memory table look-up procedure of the prior art. The present invention, however, achieves a substantial memory capacity saving by utilizing half-cycle and even quarter-cycle waveform symmetry.

Half-cycle symmetry permits bi-directional memory scanning, i.e., addressing the waveshape memory in alternately forward and rearward numerical directions as the generated number staircase alternately rises and falls. This permits a given waveform to be produced with a memory half as large. In addition, a further halving of the memory capacity requirement is achieved by a temporary transformation of the number sequence from binary offset to a sign-magnitude code notation for the purposes of the intermediate memory look-up procedure. Thereafter, the memory output is converted back from sign-magnitude to binary offset notation for use in the digital-to-analog conversion procedure.

Finally, a plurality of number staircase waveform generators are used in parallel to generate plural footages from a single note selection key. Furthermore, a single set of waveshape processing circuitry (such as an envelope modulator and a waveshape conversion memory) can be used to process all of the plural footages concurrently, by appropriate use of time-division multiplexing. A multi-phase summing circuit serves to demultiplex and combine the individual footage waveforms into a resulting waveform.

All these features of the invention will now be described in detail by reference to the following drawings.

BRIEF DESCRIPTION OF THE DRAWINGS

FIG. 1 is a functional block diagram of a numerical triangle generator in accordance with one aspect of this invention.

FIG. 2 is a functional block diagram which shows how a numerical triangle generator such as that of FIG. 1 can be used to develop an analog waveform of triangular shape.

FIG. 3 is a logic diagram showing details of the exclusive-OR inverter circuit of FIG. 1.

FIG. 9 is a functional block diagram of a waveshape generator in accordance with this invention, in which a triangular number sequence is used for memory look-up purposes, and half-cycle and quarter-cycle symmetry are exploited for the purpose of reducing memory capacity requirements.

FIG. 10 is a logic diagram showing the detailed configuration of the exclusive-OR code translation circuits of FIG. 9.

DETAILED DESCRIPTION OF THE PREFERRED EMBODIMENT

Figures 4A, 4B, 4C, 6A, 6B, 6C, 6D, 6E, 6F:
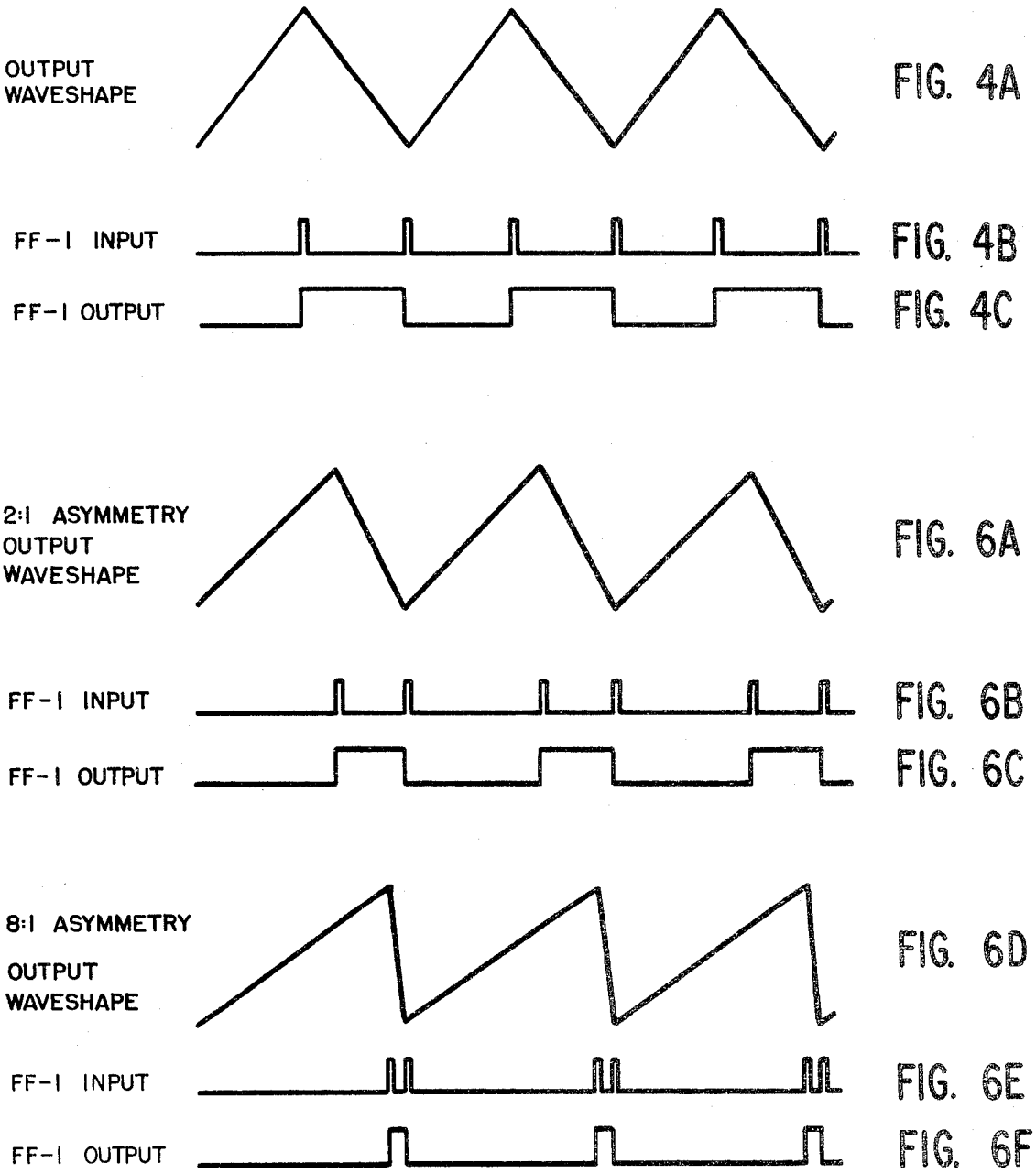
FIGS. 4A through C are a series of waveform diagrams, coordinated to a common time scale, illustrating the operation of the circuitry in FIGS. 1 and 2.
FIGS. 6A through C and 6D through F are two separate series of waveform diagrams illustrating the operation of the circuitry in FIGS. 5 and 2 for 2:1 and 8:1 asymmetry respectively. Both series of waveform diagrams are coordinated to the time scale of FIGS. 4A–C.

In U.S. patent application Ser. No. 835,832 filed Sept. 22, 1977 by R. Swain and D. Moore, entitled TONE GENERATING SYSTEM FOR ELECTRONIC MUSICAL INSTRUMENT, and now U.S. Pat. No. 4,186,637, there is described an electronic digital organ in which each keyboard-selected note is fully described by means of two binary digital codes: a note code which specifies the place of the note within its octave, and an octave code which specifies the particular octave within which the note falls. In the discussion which follows, it will be assumed that the waveform generators described herein are used in conjunction with a similar note designation system.

In particular, FIG. 1 illustrates a numerical triangle generator 20 which is designed to respond to a digital note code arriving on an input cable 22 and a digital octave code arriving on another input cable 24. The note code on cable 22 is translated by a pitch ROM 26 into a pitch code appearing on a cable 28, which constitutes a binary-coded digital representation of the pitch of the note indicated by the input code on cable 22.

The pitch code on cable 28, however, simply designates the musical scale value of the keyboard-selected note within a given octave. In order to scale the pitch code on cable 28 so that it constitutes a musical scale value representing the position of the selected note relative to the entire organ keyboard, an octave scaler 30 is used. This is a device which shifts the incoming pitch code on cable 28 by one or more binary places. Each such shift constitutes multiplication or division by factor of 2, and each factor of 2 is of course an octave translation. The number of places or octaves by which the pitch code on cable 28 must be shifted is determined by the value of the octave code arriving on cable 24. An off-the-shelf device which can perform the functions of the octave scaler 30 is the Signetics model 8243 integrated circuit scaler.

The output of the octave scaler 30, appearing on a cable 32, becomes one of two inputs to a digital adder 34. The sum output of the adder is produced on a cable 36 and stored in a digital latch 38 loaded in response to a clock input arriving on a lead 40. Thus, at regular intervals the sum of the two inputs to the adder 34 is read into storage in the latch 38.

At the same time that each new sum output from the adder 34 enters the latch 38, the previous sum in the latch is read out on a cable 42 which has a feedback loop 42A carrying the latch output back around to the second input of the adder 34. As a result, at each clock interval the musical scale value appearing on cable 32 is added to the output of the latch 38. But the latch output in itself is the accumulation of all previous musical scale value addition operations. Thus, in effect the musical scale value on the cable 32 is repetitively added to itself once each clock interval. The result is a steadily ascending series of numerical values appearing on the output cable 42 of the latch 38.

In order to avoid quantization noise, the adder 34 has at least a twelve bit capacity, with a 13th bit appearing as a carry output (CO) on an overflow line 44. (The adder 34 also has a carry input (CI) which can be applied over a lead 46; but in this embodiment of the invention there is no signal on the line 46. It does have a purpose, however, which will appear later in connection with subsequent embodiments of the invention.)

Each carry out bit is stored for one clock interval in the latch 38 and in the next clock interval is read out on a carry line 48 which switches a flip-flop FF1. As a result, the flip-flop FF1 switches high on every alternate carry output appearing on line 48. Thus, the Q output is high for the time required for the adder 34 to build up to one carry output, then low for the time required for the adder to build up to the next carry output, then high again, and so on.

The Q output, when high, appears on a line 50 and enables an exclusive-OR circuit 52. When enabled, this circuit inverts the latch output appearing on cable 42. But when the Q output appearing on line 50 is low, the exclusive-OR circuit 52 simply passes the data on cable 42 straight through without change. Accordingly, the exclusive-OR gate output appearing on cable 54 alternates between an identical copy of the data appearing on cable 42 and its inverse. The specific logic of the exclusive-OR circuit 52 is detailed in FIG. 3. A series of individual exclusive-OR gates 56 is each enabled by the flip-flop Q output appearing on line 50. The other inputs to each of the gates 56 are various bits of the latch output 42. The outputs of the gates 56 collectively make up the data on cable 54.

To summarize what has been said so far, the data output on cable 42 is a rising sequence of numbers obtained by repetitively adding the musical scale value which appears on the cable 32. Each time this rising series of values exceeds the modulus of the adder 34, a carry output is produced on lines 44 and 48 which switches the flip-flop FF1 and changes the state of the exclusive-OR circuit 52 from enabled to disabled or vice versa. When the exclusive-OR circuit 52 is disabled, each series of rising values on its input cable 42 appears unchanged on its output cable 54. But while the exclusive-OR inverter circuit 52 is enabled each series of rising values appearing on its input cable 42 will appear on its output cable 54 as a falling series of numerical values because of the inversion effect. The net result, then, is an alternately rising and falling series of numerical values appearing in binary digital form on the output cable 54.

To see how this alternately rising and falling numerical staircase can be utilized in one form of the invention, refer next to FIG. 2, where the entire triangle generator circuit of FIG. 1 is represented by a block 20 with its note code input 22, octave code input 24, and clock input 40. The alternately ascending and descending numerical staircase output on cable 54 goes to a digital envelope modulator 60. The envelope modulator 60 is turned on whenever a "key down" signal appears on a lead 62. The output of the envelope modulator 60 appears on a cable 62 and goes to a digital-to-analog converter 64 which converts each succeeding digital quantity in the ascending and descending number series into a corresponding analog voltage which appears on the audio output line 66. As a result, the envelope-modulated alternately ascending and descending sequence of digital numbers appearing on cable 62 is converted into an alternately ascending and descending sequence of analog voltages representing sample points on an output waveform. With appropriate capacitive smoothing, which occurs in the digital-to-analog converter 64, this waveform appears on the audio output line 66 as a smoothly connected analog waveform corresponding to the envelope-modulated digital number sequence.

Further clarification of the operation of the circuit of FIGS. 1, 2 and 3 is available from a study of the waveform diagrams in FIGS. 4A–C. FIG. 4A shows the analog voltage waveshape appearing on line 66 of FIG. 2. Note that it is a triangular waveform which is symmetrical about each peak; that is to say that the leading and trailing edges of each triangle are mirror images of each other. This is because the time which it takes the adder 34 to add up to a carry output is the same for each adder cycle, regardless of whether that particular adder cycle is one which occurs while the exclusive-OR circuit 52 is disabled, and therefore gives rise to an ascending segment of the output waveform, or one which occurs while the exclusive-OR inverter circuit 52 is enabled, giving rise to a descending segment of the output waveform. Note that each maximum and minimum peak of the output waveform in FIG. 4A coincides with a carry input to the flip-flop FF1 as shown in FIG. 4B. The resulting switching of the flip-flop FF1 is depicted in FIG. 4C, where it is seen that each time the Q output on line 50 is low, thus disabling the inverter circuit 52, the output waveform in FIG. 4A rises to a maximum; while each time the Q output on line 50 is high, thus enabling the inverter circuit 52, the output waveform descends to a minimum.

Figure 5:
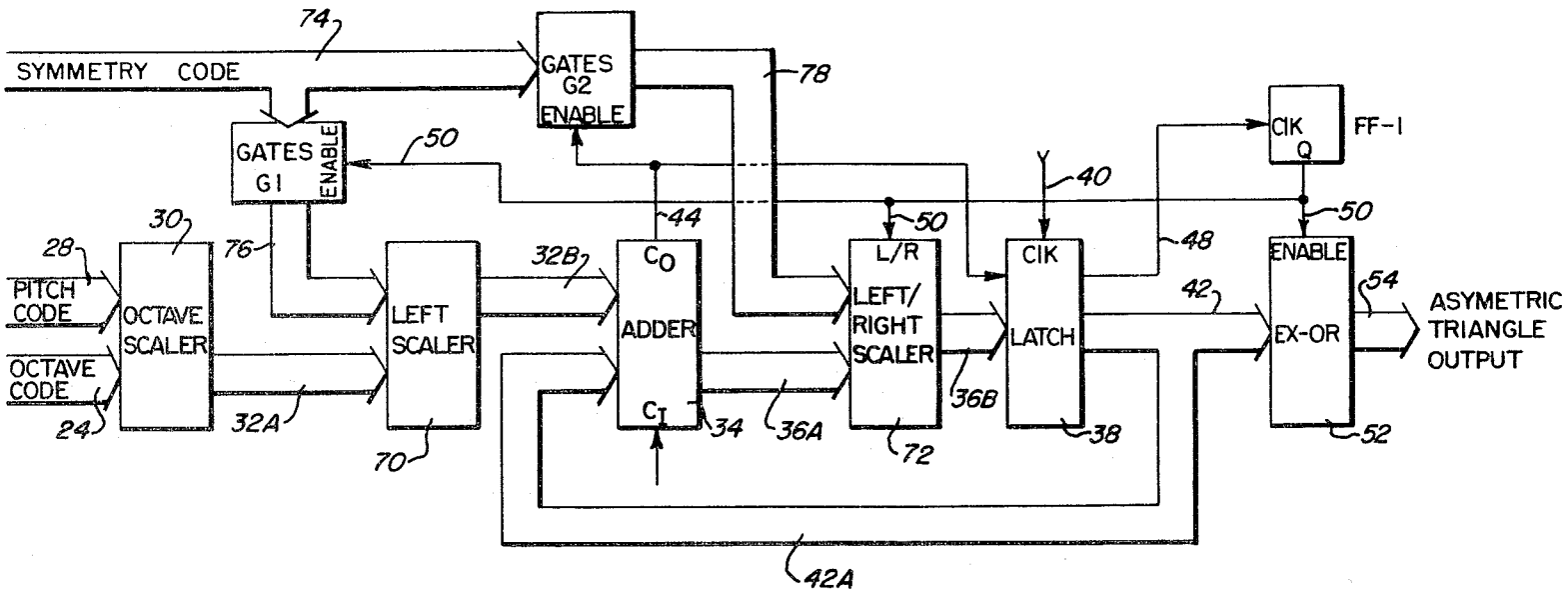
FIG. 5 is a functional block diagram of a numerical triangle generator in accordance with this invention, which is capable of generating triangular configurations with a selected degree of asymmetry.

FIG. 5 shows a modification of the triangle generator circuit of FIG. 1, which operates in fundamentally the same fashion but has the added capability of producing a selected degree of asymmetry between the leading and trailing edges of the triangular waveform. The major difference between the circuits of FIG. 5 and FIG. 1 is that in FIG. 5 there are a pair of scaler circuits 70 and 72 which are arranged to modify the inputs to the adder 34 and latch 38 respectively. In the case of scaler 70, the output of the octave scaler 30 arrives on cable 32A, is shifted one or more binary places to the left by the scaler 70, and then is outputted on a cable 32B to the adder 34. In the case of the scaler 72, the output of the adder 34 arrives on a cable 36A, is shifted one or more binary places either to the left or to the right, and then is outputted on a cable 36B to the latch 38. The number of places by which the data is shifted by each of the scalers 70 and 72 is determined by a symmetry code input arriving on a cable 74. Access of the symmetry code to the scalers 70 and 72 is controlled, however, by gates G1 and G2 respectively. When gates G1 are enabled, the symmetry code appears on a cable 76 and becomes the control input to the scaler 70. When gates G2 are enabled, the symmetry code appears on a cable 78 and becomes the control input to the scaler 72.

The enabling input to gates G1 appears on line 50. It will be recalled from the discussion of FIG. 1 that this line carries the Q output of flip-flop FF1, and thus goes high only during the alternate half-cycles when the output waveform is falling. During the other alternate half-cycles when the output waveform is rising, the flip-flop Q output is low and line 50 therefore does not enable the gates G1. As a result, the symmetry code on line 74 is not then transmitted over line 76 to the left scaler 70. But during the half-cycle when the symmetry code is available over line 76 to the left scaler 70, it shifts the data on cable 32A to the left by the number of binary places which is indicated by the symmetry code. During the intervals when the symmetry code is not available on cable 76, the scaler circuit 70 passes the data input of cable 32A without shifting it at all. Thus the data appears on cable 32B without change.

In the case of the left/right scaler 72, the flip-flop Q output on line 50 determines whether the scaler shifts to the left or to the right. As a result, during the falling half of each triangular cycle the scaler 72 shifts the data on cable 36A to the left by the number of places indicated by the symmetry code, whereas during the rising half-cycles of the output waveform the scaler 72 shifts the data on 36A an equal number of places to the right.

Accordingly, the left scaler 70 shifts the data only during the falling half-cycle of the waveform, while the left/right scaler 72 shifts the data to the left during each falling half-cycle and to the right during each rising half-cycle of the output waveform. The enabling input to the gates G2, however, is needed only for a single pulse time when the carry output from the adder 34 appears on line 44.

The effect which scaler 70 produces by left-shifting on cable 32B is to multiply the data by 2. This doubling of the numerical value of the input to adder 34 produces a larger numerical step size in the rising staricase of numerical values produced by the successive addition operations. As a result, the rising staircase of numerical values produced by the adder rises faster, and therefore has a steeper slope. But this doubling effect is limited by gates G1 to the interval when the staircase slope is reversed by the exclusive-OR gates 52. Therefore the descending portion of the waveform, i.e. the trailing edge of the triangular wave, is the only part which is affected. Consequently, the descending or trailing edge takes larger step sizes than the rising, leading edge, and descends more rapidly than the latter ascends. This is apparent from FIG. 6A, where a 2:1 asymmetry relationship causes the trailing edges of the waveform to be noticeably steeper than the trailing edges of the symmetrical waveform in FIG. 4A. The change is even more pronounced in FIG. 6D, where an 8:1 asymmetry relationship produces an even steeper trailing edge. In contrast, since the leading or rising edge of the waveform is not affected by the scaler 70, due to the disabling of gates G1 by flip-flop FF1 during the first half of the cycle, the slope of the leading edge is unaffected by the symmetry code on cables 74 and 76 and is dictated entirely by the musical scale value appearing on cable 32A. The resulting waveform is asymmetrical, the exact degree of asymmetry depending on the particular value of the symmetry code input on cable 74.

If it is desired to keep the frequency of the output waveform constant as the asymmetry is imposed upon it in the manner described, it will be necessary to decrease the slope of the rising, leading edge of the waveform, thus extending its time duration to compensate for the reduced time duration of the more steeply falling trailing edge. This has been done in the examples depicted in FIGS. 4A–C and 6A–F. Probably the most convenient way to accomplish such frequency stabilization is to use a different output value from the pitch ROM 26 (see FIG. 1) appearing on the pitch code calbe 28. The pitch ROM can be programmed so that the choice of pitch code is tailored to the particular degree of asymmetry in use.

The basic asymmetry relationship between the rising and falling edges of the triangular waveform is introduced by the left scaler 70 because of the way it controls the step size in the number staircase produced by the adder 34 during alternate half-cycles of the waveform. But a matching correction by the left/right scaler 72 is also required in order to avoid distortion of the waveform. Each time the adder 34 produces a carry output on line 44, it is also switching either from the smaller addition step sizes of the leading edge to the larger addition step sizes of the smaller edge, or vice versa. Accordingly, the remainder left in the adder 34 immediately after each carry output will be either too small or too large for the following half-cycle of circuit operation. Specifically, the remainder which accumulates in the adder 34 during each rising half of the waveform will be too small to be used by latch 38 during the calculations which follow in the falling portion of the waveform, because it uses larger step sizes. Similarly, the remainder which is accumulated in the adder 34 using larger step sizes during the falling portion of the waveform will be too large to be employed in the latch 38 during the rising portion of the waveform, because it uses smaller step sizes. In order to compensate for this, when flip-flop FF1 goes high, upon the occurrence of each maximum of the waveform, the resulting high output on line 50 causes the left/right scaler 72 to shift the remainder appearing on cable 36A to the left, so that a larger remainder quantity is outputted on cable 36B to the latch 38. Similarly, upon the occurrence of each minimum of the waveform, the low output on line 50 causes the left/right scaler 72 to shift the remainder output on cable 36A to the right, so that a smaller remainder quantity appears on output cable 36B going to the latch 38. The number of places which this data is shifted to the left or the right, as the case may be, is determined by the symmetry code which appears as a control input on cable 78, because the gates G2 are enabled for one pulse interval each time that the carry output from adder 34 appears on line 44. After that one pulse interval is over, gates G2 return to their disabled condition so that there is no longer any symmetry code appearing on cable 78 as a control input to the left/right scaler 72. As a result, during the remaining clock intervals until the next carry out pulse occurs on line 44, the rest of the ascending staircase of numerical values emerging from the adder 34 on cable 36A is passed through the scaler 72 unchanged to the latch 38. Thus only the remainders are affected by scaler 72; subsequent values are unaffected.

The output of the asymmetrical triangle generator in FIG. 5 (cable 54) can be applied to an envelope modulator and D/A converter as illustrated in FIG. 2.

In FIG. 7, we again have the octave scaler 30 responding to the pitch code input on cable 28 and the octave code input on cable 24 to produce a musical scale value on cable 32. In this embodiment, however, the musical scale value on cable 32 is used as the input to two separate triangle generators 20.1 and 20.2, running concurrently. Each of the triangle generators 20.1 and 20.2 receives the clock input on lines 40, and operates in the same manner as the triangle generator 20 described in connection with FIG. 1. The generators produce respective triangle outputs, in the form of alternately rising and falling number series, on respective output lines 54.1A and 54.2A. The final output is obtained by employing a digital summing circuit 80, which calculates the digital sum of each pair of numbers presented on the cables 54.1A and 54.2 respectively. The result is a series of sums presented in digital form presented on output cable 54B. This sum is then applied to an envelope modulator and digital-to-analog converter in the manner illustrated in FIG. 2.

As the two triangle generators 20.1 and 20.2 run concurrently, a numerical differential is introduced into the stairstep calculation of one of them by means of the carry input line 46 described previously in connection with FIG. 1. The carry input 46.1 of the first generator 20.1 is left dead-ended, without any data input, just as in the case of the generator 20 described above. But the carry input 46.2 of the second triangle generator 20.2 receives a stream of data pulses from a rate multiplier circuit 82, which can be any of the standard integrated rate multiplier chips that are available on the market. The rate multiplier 82 is clocked by the same clock input 40 as the two triangle generators 20.1 and 10.2, but the multiplication factor by which the clock rate on line 40 is multiplied depends upon the data input arriving on a chorus rate cable 84. Accordingly, the clock rate is multiplied by a factor dictated by the chorus rate information on cable 84, and the resulting multiplied pulse rate is outputted on line 46.2 to the carry input of the triangle generator 20.2.

The effect of this carry input upon the operation of the triangle generator 20.2 is to introduce an arithmetic correction into the addition operation of its adder circuit 34 (see FIG. 1). Specifically, the adder 34 of generator 20.2 will calculate a more rapidly rising stairstep sequence of numerals, because of the extra input on the carry line 46.2. Since the frequency of the output waveform of each generator 20.1 and 20.2 depends upon the rate of rise of its numerical staircase, there will be slight frequency differential between the output waveforms of the two generators. This frequency differential is small enough so that the two generators produce almost but not quite equal frequencies, and therefore beat against each other in the manner required to produce a chorus effect. When the two waveforms are digitally combined in the summer 80 and read out on the output cable 54B, the beat or chorus component is included in the output and results in a richer musical sound.

It should be noted that the rate multiplier 82 can be replaced by some other form of pulse generator, such as a programmable divider driven by the clock source 40, or an oscillator synchronized with the clock source 40. The pulse generator must be synchronized with the clock, so that it adds carry input pulses at a rate which is a submultiple of the stairstep change rate, otherwise circuit operation would be chaotic.

Figure 8:
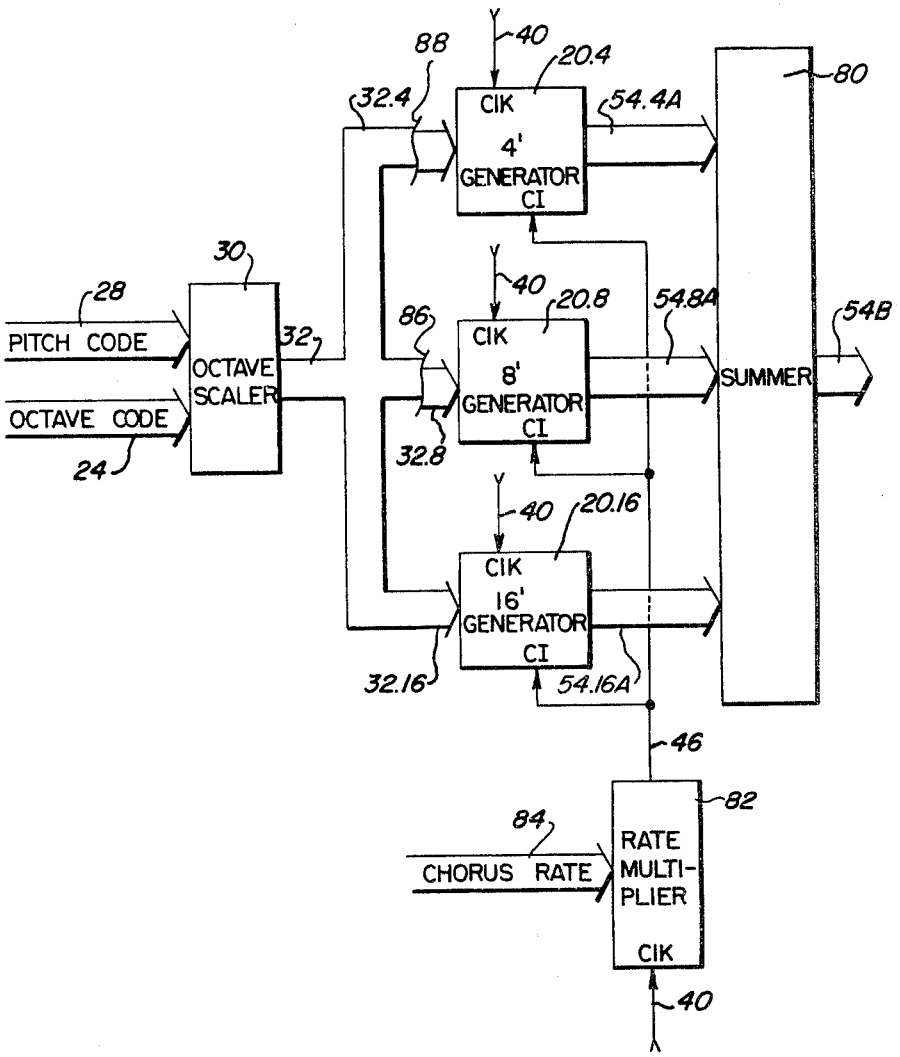
FIG. 8 is a functional block diagram of a numerical triangular generator in accordance with this invention, which generates a plurality of octavely related triangular waveforms or footages with a small frequency disparity introduced for chorus purposes.

This same technique is used to advantage in the circuit of FIG. 8. This circuit produces several different footages, or octavely related tones (such as the four foot tone, the eight foot tone and the sixteen foot tone) for a single keyboard-selected note. It also employs a carry input to produce a mutually chorusing pitch differential among the three tones. Here again the pitch code on input cable 28 and the octave code on cable 24 are processed by the octave scaler 30 and outputted on a cable 32 to three triangle generators, a four foot generator 20.4, an eight foot generator 20.8 and a sixteen foot generator 20.16, running concurrently. Their triangle outputs appear on output cables 54.4A, 54.8A and 54.16A respectively, all leading to a digital summer circuit 80 which combines these outputs digitally and outputs the digital sum on a common output line 54B. The output on cable 54B then goes to an envelope modulator and digital-to-analog converter as seen in FIG. 2.

Each of the triangle generators 20.4, 20.8 and 20.16 operates off the same clock input 40, and functions in the same manner as the triangle generator 20 described in connection with FIG. 1 above. In addition, there is a rate multiplier 82 as described above in connection with FIG. 7, which operates from the same clock input 40 and a chorus rate data cable 84. Its output line 46 goes to the carry input of each of the three footage generators 20.4, 20.8 and 20.16.

Here the musical scale value cable 32 splits into three separate input lines 32.4, 32.8 and 32.16 leading to the three footage generators 20.4, 20.8 and 20.16 respectively. The first branch of the data input cable 32.16 carries the numerical quantity on the cable 32, without change. But the other two branches 32.8 and 32.4 are wire-shifted one binary place and two binary places respectively, as indicated by the discontinuity lines 86 and 88 respectively. As a result of these binary place shifts, the musical scale value inputted to the eight foot generator 20.8 represents double the musical frequency, i.e., a musical note one octave higher than the original input on cable 32. As a result, the frequency of the waveform generated by the eight foot generator 20.8 is an octave higher than that of the waveform generated by the sixteen foot generator 20.16. Similarly, the musical scale value represented by the two-place shifted cable 32.4 is four times that of the numeral on cable 32, corresponding to a musical note two octaves higher. This causes the four foot generator 20.4 to generate a triangular waveform of four times the frequency, or two octaves higher, relative to the waveform of the four foot generator 20.16.

Note that the same rate multiplier output on line 46 goes to the carry input of the adder 34 of each of the three triangle generators 20.4, 20.8 and 20.16. But because of the difference in the operating frequencies of the three generators 20.4, 20.8 and 20.16, the frequency shift effect on each generator is different. A given pulse rate correction on line 46 represents a different percentage frequency change in relation to the frequency of the four foot generator 20.4 than it does in relation to the frequency of the eight foot generator 20.8 or in relation to the sixteen foot generator 20.16. As a result, the effect of the single frequency modulation is to create a mutual chorus-producing frequency differential between any two of the nominally octavely related outputs of the three generators 20.4, 20.8 and 20.16.

Figure 7:
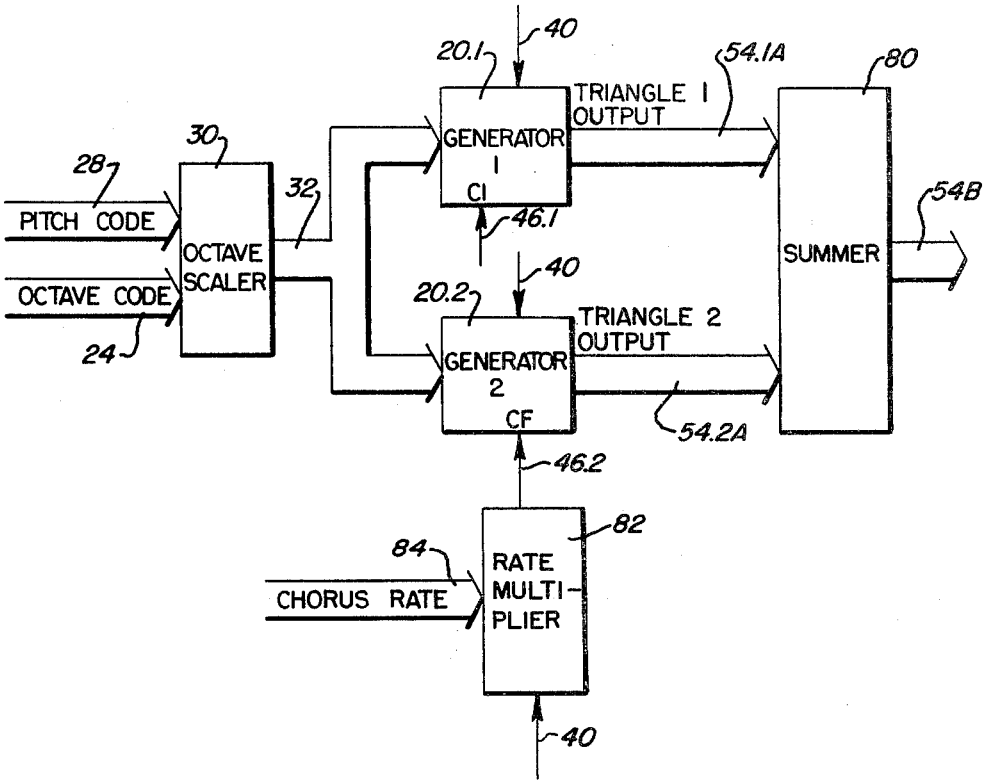
FIG. 7 is a functional block diagram of a numerical triangle generator in accordance with this invention, which generates two concurrent triangular waveforms of nominally equal frequency, but with a small frequency differential introduced for chorus purposes.

It should be pointed out that the plural waveform approaches illustrated in FIGS. 7 and 8 can be used with either the symmetrical generator of FIG. 1 or the asymmetrical generator of FIG. 5.

In each of the embodiments discussed so far, the numerical staircase output of the triangle generators has been used directly to represent a succession of analog output waveform amplitudes. It is also possible, however, to use such a numerical staircase as a series of addresses for looking up waveshape amplitudes in a memory table. This would ordinarily be done when one wishes to use the triangle output as a starting point, but wants to convert the triangle waveform to some other waveshape as an ultimate output. A circuit for doing this is illustrated in FIG. 9, which shows a triangle generator 20 of the type described in connection with FIG. 1, its pitch code input 28, note code input 24 and clock input 40. The output cable carrying the numerical staircase is split into a single line 54M which contains the most significant bit (MSB) and a plurality of lines forming the cable 54L containing all of the less significant bits (LSB's).

The LSB cable 54L is the data input to an exclusive-OR gate circuit 90 which transposes the data and outputs the transposed data on a cable 92 to a waveshape processor 94. The waveshape processor may take several alternative forms. Here it is simply a straight table look-up memory which makes a point-for-point conversion for each amplitude sampling point of the waveform to be produced. The output of the waveshape processor 94 appears on a cable 96 leading to another exclusive-OR circuit 98 which performs still another data transposition. The output, consisting of all the less significant bits emerging from the exclusive-OR circuit 98 plus the most significant bit on the line 54M, appears on a cable 54ML. This output is then fed to an envelope modulator and digital-to-analog converter as illustrated in FIG. 2.

The two exclusive-OR circuits 90 and 98 are identical, and have the internal logic configuration illustrated in FIG. 10. Each of these circuits includes a plurality of exclusive-OR gates 100, one fo each of the bit positions included in the less significant bit cable 54L. In the case of the exclusive-OR circuit 90, the inputs to each of these gates 100 are the respective bits appearing on the less significant bit cable 54L. In the case of the exclusive-OR circuit 98, these inputs constitute the equal number of bits appearing on cable 96. In the case of the exclusive-OR circuit 90, the output on cable 92 consists of the outputs of all of the gates 100, while in the case of exclusive-OR circuit 98, the output on cable 54 ML consists of the less significant bits, i.e. all of the outputs of gates 100, plus the most significant bit on line 54M. An enabling input 102 constitutes a second input to each of the gates 100.

An analysis of the logic table for the circuit illustrated in FIG. 10 would show that it has an interesting characteristic. If the input 54L comprises all the less significant bits of a given binary digital number, and the input 54M constitutes the inverse of the most significant bit of that number, then the circuit converts bilaterally between the binary offset and sign-magnitude systems of notation: i.e. it converts an input in binary offset notation into an output in sign-magnitude notation; and conversely, it converts an input in sign-magnitude notation into an output in binary offset notation. Binary offset is a notation which assigns a zero value to the minimum scale value of a waveform, and then considers every higher value to be a positive quantity appropriately offset from that zero basis. In contrast, sign-magnitude notation is a system in which the most significant bit of a binary word represents merely the polarity of a number (a logical one representing a positive sign and a logical zero representing a negative sign), while the less significant bits represent the magnitude of the number.

The alternately rising and falling sequence of numbers generated by the triangle generator 20 inherently employs binary offset notation, because the adder 34 (see FIG. 1) is only capable of producing a sequence of positive numbers increasing from zero, while the inverted output of the exclusive-OR circuit 52 (see FIG. 1) when it is enabled is simply a sequence of positive values decreasing towards zero. Therefore, the binary offset output of the triangle generator 20 is converted by exclusive-OR circuit 90 into sign-magnitude notation for the purposes of the amplitude conversion operation performed by the waveshape converter 94. After this waveshape conversion operation is over, the output on cable 96, which is still in sign-magnitude notation, is converted back into binary offset form by the exclusive-OR circuit 98 so that the output on cable 54ML is useful in driving the digital-to-analog converter 64 of FIG. 2 to produce an appropriate analog waveform.

As noted above, in order for the exclusive-OR circuits 90 and 98 to function as binary offset to sign-magnitude, and sign-magnitude to binary offset, converters respectively, the enabling input 102 to each of the gates 100 must be the inverse of the most significant bit of the data. Accordingly, the most significant bit (line 54M) is inverted by an inverter I and applied over line 102 as the enabling input to all the exclusive-OR gates 100 of circuits 90 and 98.

Figures 11A, 11B, 11C, 11D, 11E, 11F, 11G, 12A, 12B, 12C, 12D, 12E, 12F, 12G:
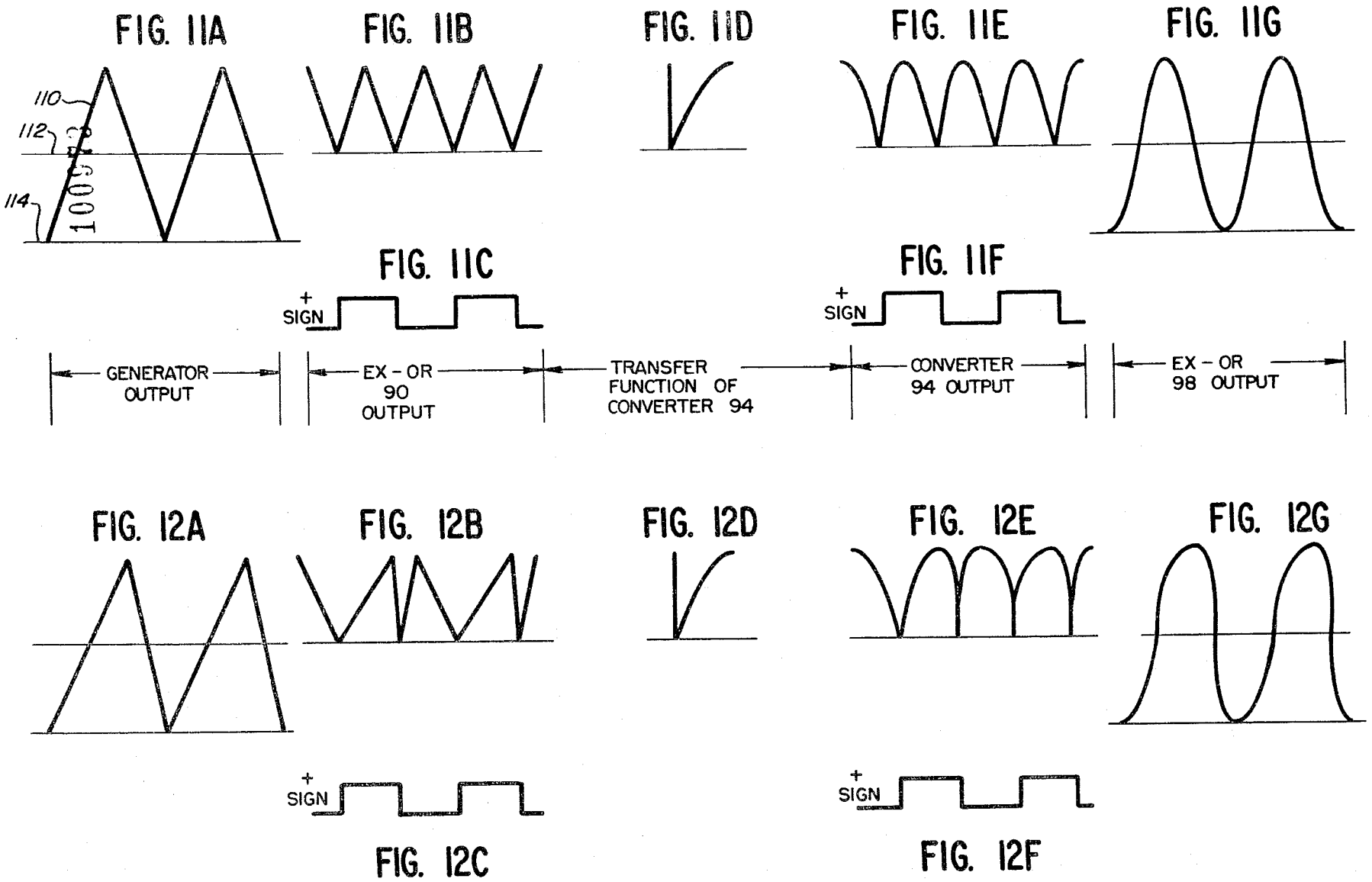
FIGS. 11A through G are a series of waveform diagrams illustrating the operation of the circuit of FIGS. 9 and 10 in conjunction with a symmetric triangle generator such as that of FIGS. 1 and 2. Within this series, FIGS. 11B and C are coordinated to a common time scale, and FIGS. 11E and F are similarly coordinated.
FIGS. 12A through G are a series of waveform diagrams which, for comparison purposes, are identical in every respect to FIGS. 11A through G respectively except that the FIG. 12 series illustrates the same circuit operation in conjunction with an asymmetric triangle generator such as that of FIG. 5.

The effect of the waveshape conversion produced by circuit 94, and of the data transformation produced by the exclusive-OR circuits 90 and 98, can be appreciated by examining FIGS. 11A–11G. FIG. 11A shows the triangular waveform configuration 110 represented by the alternately rising and falling number of series produced by the triangle generator 20 in FIG. 9. A center line 112 is drawn halfway between the maximum and minimum points of this waveform; but the center line 112 is not in fact a zero line, because the staircase number sequence which produces the triangular waveform 110 is in binary offset notation. Therefore, the zero line is base line 114, which runs through the minimum points of the waveform. The first exclusive-OR gate circuit 90 converts the numerical sequence represented by the waveform in FIG. 11A to another numerical sequence represented by the waveforms in FIGS. 11B and C. FIG. 11B, where all values are confined to the range between the center line 112 and the maximum peak value in FIG. 11A, represents only the less significant bits carried on the cable 54L of FIG. 9. In order to fully characterize each number represented by the data, however, it is necessary also to show the most significant bit, which is carried on the single line 54M of FIG. 9; and this bit is represented separately in FIG. 11C, where it varies between two binary levels labeled "plus" and "minus" respectively. These figures, FIG. 11B and FIG. 11C, together constitute a sign-magnitude representation of the same data seen in FIG. 11A. FIG. 11B represents the magnitude of the data relative to line 112, now considered as a zero datum; while FIG. 11C represents the sign of the data, positive or negative.

One of the advantageous features of the waveform seen in FIG. 11A is that it displays half-cycle symmetry. That is to say, the half-cycle of the waveform in FIG. 11A which goes from a minimum point to a maximum point is simply the inverse of the other half-cycle of the waveform, which goes from a maximum point to a minimum point. As a result, when using a series of numbers corresponding to this waveform as a series of addresses for looking up amplitudes in a memory table, it is only necessary to store a half-cycle's worth of amplitude values in that memory. Then one can scan the memory from start to finish in the forward direction to produce the first half-cycle of the waveform, and then rescan it in the reverse direction, from finish to start, to produce the second half-cycle of the waveform. The output of the memory is the same as if a full cycle of amplitude values had been stored therein, and yet half the memory capacity is saved, with a resultant saving in cost.

But this invention, by virtue of the data conversion performed by exclusive-OR gate 90, goes even further. It will be appreciated that the waveform configuration in FIG. 11B reverses its slope twice as frequently as the waveform of FIG. 11A, but is otherwise identical in its triangular configuration. Therefore, when the half-cycle symmetry technique just described is applied, and the number sequence represented by FIG. 11B is used instead of the FIG. 11A sequence as a series of memory look-up addresses, we achieve half-cycle symmetry with respect to the waveform of FIG. 11B, which is equivalent to quarter-cycle symmetry relative to the original waveform of FIG. 11A. As a result, the capacity of the memory incorporated in the waveshape converter 94 need only be large enough to store a quarter-cycle of the original FIG. 11A waveform.

The most significant bit on line 54M, represented by FIG. 11C, need not be processed at all by the waveshape converter 94. As seen in FIG. 9, the most significant bit on line 54M bypasses the waveshape converter 94 entirely, and is reunited with the less significant bits only on the downstream side, where it joins the output cable 54ML. Electronically, the only function of the most significant bit on line 54M, in this table look-up process, is to actuate the inverter I, thus providing the inverted bit on line 102 which acts as the enabling input to the exclusive-OR gates 100 of circuits 90 and 98. FIG. 11D shows a typical transfer function which might be stored in the memory of the waveshape converter 94. Note that it need only be one-half cycle in length, relative to the actual input waveform of FIG. 11B, which is equivalent to one-quarter cycle of the initial waveform of FIG. 11A. The output which such a transfer function produces on the waveshape converter output cable 96 is illustrated in FIG. 11E. FIG. 11E represents only the less significant bits appearing on cable 96, while FIG. 11F is needed to indicate the most significant bit, which represents the sign varying periodically from plus to minus, and appears on the single line 54M. This output data is then reassembled into binary offset notation by the exclusive-OR circuit 98, so that the resulting output on cable 54ML is a numerical sequence re-coded in binary offset notation and representing the sinusoidal waveform pictured in FIG. 11G.

FIGS. 12A–G illustrate how the same waveform transformation process would work if the same transfer function (FIG. 11D or 12D) were used to process the asymmetrical triangular waveform seen in FIG. 12A. Such an asymmetric waveform might be one which is produced by an asymmetrical triangular waveform generator of the kind described above in connection with FIG. 5. FIG. 12A shows the asymmetrical waveform in binary offset notation. FIGS. 12B and C show how it would appear after conversion by the exclusive-OR circuit 90 to sign-magnitude notation. FIG. 12B illustrates the magnitude waveform configuration represented by the less significant bits, while FIG. 12C shows the sign represented by the most significant bit. FIG. 12D is the transfer function of the waveshape converter 94, and is identical to FIG. 11D. FIGS. 12E and F show the converted output of the circuit 94, FIG. 12E representing the less significant or sign bit. Finally, FIG. 12G shows the equivalent waveform of the asymmetrical sinusoidal number sequence output, after it has been reconverted to binary offset form.

Figure 13:
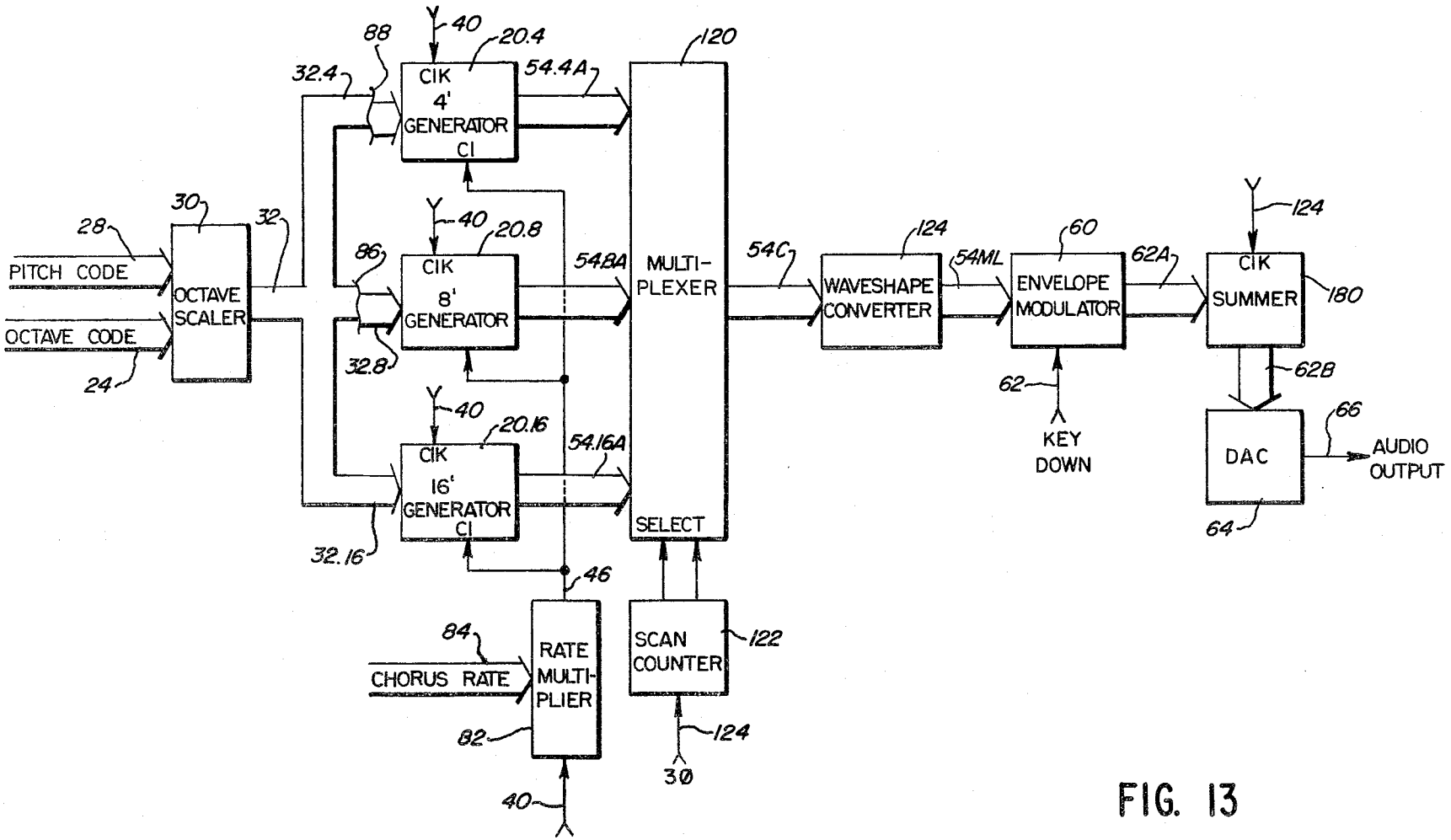
FIG. 13 is a functional block diagram of a waveform generator in accordance with this invention, which generates plural footages but is able to process these footages in a single waveform converter and envelope modulator by means of time-division multiplex techniques.

The embodiment of FIG. 13 combines the features of FIGS. 8 and 9 by means of conventional time-division multiplexing techniques. The front end of the circuit depicted therein is identical to the plural footage generator of FIG. 8. It shows the pitch code data input on cable 28 and octave code data input on cable 24 arriving at an octave scaler 30. The scaler output on cable 32 is split into a normal musical scale input value 32.4, an eight-foot scale value input 32.8 which is wire-shifted as indicated by the slip line 86, and a sixteen-foot scale value input 32.16 which is wire-shifted two places as indicated by the slip line 88. These data inputs go to respective four foot, eight foot and sixteen foot triangular generators 20.4, 20.8 and 20.16 respectively. Each of these generators receives the clock input 40, and the chorusing input 46 from a rate multiplier 82. The rate multiplier receives its chorus rate data input on cable 84, and also receives the same clock input on line 40 as the three footage generators. The three footage generator outputs appear on cables 54.4A, 54.8A and 54.16A respectively; and are combined in a conventional time-division multiplexer 120.

This multiplexer repetitively divides the time domain into three parts, one for each of the data outputs on cables 54.4A, 54.8A and 54.15A. It does this under control of a scan counter 122 which is driven by a three phase clock input on a line 124. As a result, the three data inputs are combined in time sequence on a single output data cable 54C going to a waveshape converter 124, which comprises all the circuitry which is enclosed within the box 124 of FIG. 9. Since the three data inputs on cable 54C reach the waveshape converter in sequential fashion, the waveshape converter 124 deals with them in sequence and outputs the converted waveform information sequentially on the cable 54ML. This three-phase waveform data then goes to the envelope modulator 60 which is actuated by the key-down signal input on line 62 (see FIG. 2). The three-phase data is processed sequentially by the envelope modulator and outputted in sequential form on data cable 62A.

The three-phase data on cable 62A is next demultiplexed and summed by a three-phase summer circuit 180 of conventional design, which is driven by the same three-phase clock input 124 as the multiplexing scan counter 122. The effect of the operation of the summer 180 is to add all the data in the three consecutive multiplexed data phases into a single combined data phase. The single phase data output is issued on a cable 62B leading to the digital-to-analog converter 64. The final analog audio output appears on line 66.

The unique advantages of the various embodiments of this invention will now be reviewed and summarized for the appreciation of the reader. The embodiment of FIG. 1 shows a specific technique for practicing the numerical ladder triangular waveform generation technique and adapting it to the environment of a particular type of musical instrument which represents musical notes in the form of a note code and octave code. FIG. 2 illustrates the way in which such a triangular sequence of numerical values can be envelope-modulated under keyboard control, and converted directly into an analog audio output waveform. FIG. 3 shows a specific inverter circuit for making a numerical staircase output alternately ascend and descend in value to form a triangular sequence. FIG. 5 shows how the triangular sequence can achieve the additional sophistication of controlled asymmetry so that a wider variety of musical effects can be achieved. FIG. 7 shows how the inherent arithmetic characteristics of the triangular numerical staircase generator can be used to advantage for generating a chorus relationship between two waveforms. In FIG. 8 this chorusing technique is applied in a novel way to the generation of plural footages actuated by a single musical key actuation. In FIG. 9 the triangular numerical staircase technique is used for table look-up purposes, rather than direct analog conversion. As a result, a triangular waveform, which is very simple to generate, can be converted to a complex waveform which is more difficult to generate directly. In particular, the asymmetrical staircase generated by the circuit of FIG. 5 can be used as the input in FIG. 9, resulting in an asymmetrical converted waveform which would be especially difficult to produce in any other way.

In addition, the technique of FIG. 9 goes beyond half-cycle symmetry to achieve quarter-cycle symmetry, resulting in a double saving in memory capacity. The circuit of FIG. 10 illustrates an exclusive-OR logic configuration which performs the necessary sign-magnitude and binary offset data conversions necessary to achieve such quarter-cycle symmetry. Finally, FIG. 13 demonstrates how time-division multiplexing techniques can enable the plural footage and chorusing aspects of the invention illustrated in FIG. 8 to be combined with the waveshape conversion aspect illustrated in FIG. 9 without duplication of circuitry.

All the foregoing embodiments of the invention are preferred at the present time, and represent the best known modes of carrying out the concepts taught herein. Nevertheless, they are presented solely for the purposes of illustration, and are not intended to limit the scope of protection which is more broadly stated in the following claims.

I claim:

1. In a triangular waveform generator of the type including means for representing a musical scale value, means for adding said musical scale value repetitively to produce an ascending series of quantities, means for periodically reversing the direction of change of said quantities to produce an alternately ascending and descending series thereof, and means responsive to said alternately ascending and descending series of quantities to produce a sequence of analog wave amplitudes each of which is a function of a respective one of said quantities; an improvement for producing asymmetry between the alternate ascending and descending phases of the resulting waveform, comprising:

means for multiplying said musical scale value before it reaches said adding means; and control means rendering said multiplying means effective or ineffective to alter the value reaching said adding means;

said control means being responsive to said reversing means to render said multiplying means effective during one of said alternate waveform phases and ineffective during the other of said alternate waveform phases.

2. A triangular waveform generator as in claim 1 wherein: said value-representing means is arranged to represent said musical scale value in digital form, and said multiplying means comprises a digital scaler operable for shifting said digital value at least one digital place in a selected direction.

3. In a triangular waveform generator as in claim 1 wherein said adding means includes (a) an adder having (i) a selected modulus, (ii) first and second inputs, and (iii) a sum output which equals the sum of said inputs, a first one of said inputs being connected to receive said musical scale value in alternately altered and unaltered form, and (b) a latch having an input connected to receive said sum output from said adder and an output connected to convey the latch contents to the second one of said adder inputs; the further improvement wherein:

said generator comprises second multiplying means connected for multiplying said sum output of said adder before it reaches said latch;

said control means is arranged to cause said second multiplying means to multiply by a selected factor during one of said alternate waveform phases, and by the reciprocal of said selected factor during the other of said alternate waveform phases;

said generator comprises means causing said selected factor to be equal to the multiplication factor employed by said first multiplying means;

said adder comprises an overflow output;

said generator comprises means responsive to said overflow output from said adder to enable said second multiplying means to multiply said sum output of said adder by said selected factor, or by its reciprocal, at the time when said sum output equals the remainder of a sum in excess of said modulus; and said second multiplying means is arranged to multiply by a factor of one when not enabled by said adder overflow output.

4. A triangular waveform generator as in claim 3 wherein:

said adder is arranged to represent said output sum in digital form, and said second multiplying means comprises a digital scaler connected between said adder output and said latch, and operable in response to said control means to shift said sum output at least one digital place, in a selected direction during a selected one of said alternate waveform phases, and in the opposite direction during the other of said waveform phases.

5. A triangular waveform generator as in claim 4 wherein:

said control means, and said means for enabling said second multiplying means, comprise respective data gates, a symmetry code data input specifying said selected multiplication factor and controlled by said gates, and respective data outputs of said gates leading to respective control inputs of said respective multiplying means;

said control inputs are arranged to control selection of said multiplication factor for said multiplication means, said data gates for said first multiplying means are connected to be enabled by said reversing means during alternates ones of said waveform phases, and said data gates for said second multiplying means are connected to be enabled for the duration of said adder overflow output.

6. In a musical tone source of the kind having a first waveshape generator which includes means for generating a first ascending series of quantities and means responsive to said series of quantities to produce a sequence of analog wave amplitudes each of which is a function of a respective one of said quantities; the improvement comprising:

a second waveshape generator which includes means for generating a second ascending series of quantities, at least one of said means for generating an ascending series of quantities including a digital adder and means causing said adder to add a digital musical scale value repetitively to produce said ascending series of quantities, said adder including means for receiving a digital carry input;

combining means cooperating with said analog wave amplitude producing means to produce a sequence of analog wave amplitudes each of which is a function of the sum of a respective pair of said quantities of said first and second series respectively; and means for applying a digital carry input to said receiving means of said adder for creating a differential between the respective rates of ascent of said first and second series of quantities, whereby to produce a chorus effect.

7. A musical tone source as in claim 6 wherein said means for applying said digital carry input comprises a pulse generator operating at a frequency which is a submultiple of the rate of change of the series of quantities to which said digital carry input is applied.

8. A musical tone source as in claim 7 wherein said pulse generator comprises:

a rate multiplier having an output;

means connecting said rate multiplier output to said carry input receiving means;

a clock input providing a fixed input rate to said multiplier; and a chorus rate input connected to said rate multiplier for determining the output rate delivered to said carry input receiving means as a function of said clock input rate.

9. In a triangular waveform generator of the type including means for representing a musical scale value, means for adding said musical scale value repetitively to produce an ascending series of quantities, means for periodically reversing the direction of change of said quantities to produce an alternately ascending and descending series thereof, and means responsive to said alternately ascending and descending series of quantities to produce a sequence of analog wave amplitudes each of which is a function of a respective one of said quantities; the improvement wherein:

said means for adding said musical scale value comprises an adder having a carry output and a latch which is arranged to store said ascending series of quantities and the carry output of said adder; and said means for periodically reversing the direction of change includes means for inverting said series of quantities whereby to reverse the ascent thereof, said inverting means being capable of being enabled and disabled, bistable means connected to enable said inverting means in one of its states and to disable said inverting means in its other state, and means coupling said adder carry output to switch said bistable means back and forth on respective alternate carries of said adder.

10. A plural footage chorusing musical tone source comprising:

means for representing a selected musical scale value;

at least two waveshape generators clocked at the same effective rate, each of the type having an input and including means for generating an ascending series of quantities by repetitively adding respective values received at said inputs;

means responsive to said musical scale value representing means to connect to one of said waveshape generator inputs a musical scale value related to said selected value, and to the other of said waveshape generator inputs a musical scale value which differs from said related value by a factor of two, whereby the frequencies of the respective waveshapes generated thereby are octavely related; and means for introducing the same selected arithmetic correction into both of said ascending series of quantities, whereby the respective effects of said correction on said two series are different in porportion to said two waveshape frequencies, so as to produce a chorus differential between said two frequencies.

11. A musical tone source as in claim 10 wherein:

said two means for generating respective ascending series of quantities operate at synchronized rates of change and include respective digital adders and respective means causing said adders to add said respective effective input values repetitively;

said adders including respective means for receiving respective digital carry inputs;

said arithmetic correction means includes a pulse generator having an output and operating at a frequency which is synchronized with said rates of change of said respective ascending series of quantities; and said tone source comprises means connecting said pulse generator output to both of said carry input receiving means.

12. A musical tone source as in claim 11 wherein said synchronized pulse generator comprises:

a rate multiplier, a clock input providing a fixed input rate to said multiplier, and a chorus rate input connected to said rate multiplier for determining the output rate delivered to said carry input receiving means as a function of said clock input rate.

13. A polyphonic musical instrument comprising:

means for selecting one from among a plurality of musical notes to be sounded;

first means, responsive to the selection of a single note by said note-selecting means, for representing the musical scale value of the selected note;

one or more second means, each responsive to said first value-representing means, to derive respective representations of the musical scale values of one or more footage notes respectively related by one or more octaves to the selected note;

a plurality of means, responsive to said first, and each of said second, value-representing means respectively, to repetitively add said selected note musical scale value and said footage note musical scale values respectively, whereby to generate respective ascending series of quantities;

respective means for periodically reversing said ascending series whereby to produce respective alternately ascending and descending series of quantities representing successions of amplitudes of respective periodic waveforms of octavely related frequencies;

summing means for combining said respective series of quantities, whereby to derive a single series of sum quantities representing a combined waveform; and output means responsive to said series of sum quantities to produce a series of analog wave amplitudes corresponding respectively thereto.

14. A polyphonic musical instrument as in claim 13, further comprising:

means for time-division multiplexing of said respective series of quantities, whereby to transmit them all over a single channel in the form of sequential phases; and waveshape-changing means responsive to said means for time-division multiplexing to change each of said respective series of quantities sequentially whereby to represent respective altered waveforms;

said summing means being arranged to sum said sequential phases whereby to demultiplex said changed series of quantities and derive from them a single series of sum quantities representing the sum of said changed waveforms.

15. A polyphonic musical instrument as in claim 14 wherein said waveform-changing means comprises:

a memory which stores in successive addresses a series of successive waveshape amplitudes; and means employing said alternately ascending and descending quantities to access said memory addresses in forward and reverse order respectively, whereby to read out said successive waveshape amplitudes in alternately forward and reverse sequence respectively.

16. A polyphonic musical instrument as in claim 14 wherein said waveshape-changing means comprises an envelope modulator arranged to impose an envelope limitation upon said respective series of quantities.

17. A polyphonic musical instrument as in claim 13 further comprising means for creating a differential between the respective rates of ascent of said series of quantities, whereby to produce a chorus effect.

* * * * *